US007017958B1

(12) United States Patent
Bowers

(10) Patent No.: US 7,017,958 B1
(45) Date of Patent: Mar. 28, 2006

(54) GATE LATCH

(76) Inventor: Clifford Allen Bowers, 3890 Hagerman Rd., Toddville, IA (US) 52341

( * ) Notice: Subject to any disclaimer, the term of this patent is extended or adjusted under 35 U.S.C. 154(b) by 52 days.

(21) Appl. No.: 10/248,333

(22) Filed: Jan. 9, 2003

(51) Int. Cl.
*E05C 19/08* (2006.01)

(52) U.S. Cl. ..... 292/281; 292/283; 292/DIG. 17; 292/DIG. 29; 256/1; 256/73

(58) Field of Classification Search ..... 292/281, 292/283, DIG. 17, DIG. 29, 292, 293, 302, 292/DIG. 64, 213, 218, 204, 207, 284, 295, 292/150; 256/1, 73; 403/315–317, 321, 403/324; 70/129, 54–56, 135–137
See application file for complete search history.

(56) References Cited

U.S. PATENT DOCUMENTS

| | | | | | |
|---|---|---|---|---|---|
| 258,833 | A | * | 5/1882 | White | 70/429 |
| 1,259,018 | A | * | 3/1918 | Hoover | 292/216 |
| 1,834,678 | A | * | 12/1931 | Bryant | 292/283 |
| 2,074,759 | A | * | 3/1937 | Richards | 292/68 |
| 2,358,914 | A | * | 9/1944 | Dray | 292/148 |
| 2,940,790 | A | * | 6/1960 | Ingalls et al. | 292/148 |
| 3,042,435 | A | * | 7/1962 | Wieseler et al. | 292/213 |
| 3,083,561 | A | * | 4/1963 | Sussina | 70/139 |
| 3,492,036 | A | * | 1/1970 | Young | 292/213 |
| 3,517,724 | A | * | 6/1970 | Jones | 160/328 |
| 3,698,752 | A | * | 10/1972 | Edwards | 292/104 |
| 3,751,084 | A | * | 8/1973 | Lening | 292/114 |
| 3,857,593 | A | * | 12/1974 | Lening | 292/5 |
| 3,871,134 | A | * | 3/1975 | Lening | 49/425 |
| 3,888,527 | A | * | 6/1975 | Haisler | 292/213 |
| 3,901,480 | A | * | 8/1975 | Basile et al. | 256/32 |
| 3,906,760 | A | * | 9/1975 | Parker, Jr. | 70/154 |
| 3,907,345 | A | * | 9/1975 | Martini | 292/68 |
| 3,918,753 | A | * | 11/1975 | McCormack et al. | 292/216 |
| 3,926,018 | A | * | 12/1975 | Joersz | 70/19 |
| 4,111,475 | A | * | 9/1978 | McCormick et al. | 292/216 |
| 4,135,747 | A | * | 1/1979 | Melilli | 292/175 |
| 4,387,916 | A | * | 6/1983 | Lening et al. | 292/5 |
| 4,592,578 | A | * | 6/1986 | Martin | 292/40 |
| 4,687,238 | A | * | 8/1987 | Mintz | 292/137 |
| 4,919,463 | A | * | 4/1990 | McQuade | 292/120 |
| 4,932,692 | A | * | 6/1990 | Nelson | 292/148 |
| 4,943,096 | A | * | 7/1990 | Looper | 292/213 |
| 5,016,928 | A | * | 5/1991 | Segovia | 292/213 |
| 5,024,473 | A | * | 6/1991 | McQuade | 292/120 |
| 5,098,140 | A | * | 3/1992 | Kentner | 292/247 |
| 5,143,413 | A | * | 9/1992 | Vandenhoek | 292/302 |
| 5,147,331 | A | * | 9/1992 | Rust | 292/246 |
| 5,226,684 | A | * | 7/1993 | De La Garza | 292/213 |
| 5,595,073 | A | * | 1/1997 | Sullivan | 70/18 |
| 5,964,548 | A | * | 10/1999 | Akins et al. | 403/398 |
| 6,422,613 | B1 | | 7/2002 | Boroviak | |

* cited by examiner

*Primary Examiner*—Brian E. Glessner
*Assistant Examiner*—Carlos Lugo
(74) *Attorney, Agent, or Firm*—Glenn Johnson; Ryan N. Carter

(57) ABSTRACT

A latching and locking mechanism for fence gates or doors. The gate latch of this invention is comprised of a steel locking pin that slides through the latch device. When the locking pin slides out of the latch device, the gate can easily be opened or closed. When the locking pin is inserted through the latch device and around the gate, the gate is held in a closed position. The locking pin can be locked in the closed position with a lock.

12 Claims, 10 Drawing Sheets

GATE LATCH

BACKGROUND OF INVENTION

This invention relates to a latching and locking mechanism for fence gates or doors. Gate latches generally provide a convenient way for securing fence gates in a closed position while still allowing the gate to be opened with minimal effort. Examples of fenced areas that may require these types of gate latches include cattle yards, stock yards for goods, and warehouses. One method used for locking a gate in a closed position is to wrap a length of chain around the gate and a sturdy gate post. However, there are several problems with using a chain in this manner. First of all, the chain links are often not as sturdy as the gate, and they can break when force is applied. A second problem is that it is difficult to secure the chain tight enough so the gate does not blow in the wind. Chains can also easily get misplaced since there is no good place to put the chain while the gate is in the open position.

Some gates use latching mechanisms to close and lock them. One popular gate latch uses the force of gravity to pull a gate latch down into a catch bracket when the gate is forced closed. This type of gate latch requires one piece of the latch to be mounted on the gate, and another piece to be mounted on a fixed object, such as a gate post. These gate latches usually provide a mechanism for locking the gate once it is in the closed position. The lock mechanism provides a hole through which a lock can be placed that locks both mounted pieces together. The problem with these types of gate latches is that even if the gate is locked with a padlock, the gate can still be opened by removing the bolts that mount the gate latch assembly to the gate or post. This means it is possible for intruders to enter the area even if the latch is padlocked shut. Another limitation presented by the currently available latch mechanisms is that they often are weaker than the posts to which they are affixed, and thus they may be broken to gain forced entry. Thus, there is a need for a gate latch that is easily opened and closed, yet provides strength, durability and security to the fenced area in the locked position.

SUMMARY OF INVENTION

It is the object of this invention to provide a gate latch that is strong and durable while securely locking gates and doors, yet is still easy and convenient to open and close. The gate latch of this invention is comprised of a steel locking pin that slides through the latch device. When the locking pin is slid out of the latch device, the gate can be opened or closed. When the locking pin is inserted through the latch device and around the gate, the gate is held in a closed position. The locking pin can be locked in the closed position with a lock securing the gate in a closed position.

In all embodiments of this invention, the components of the latch device are made of a sturdy material, preferably stainless steel. Stainless steel makes the device strong and durable, typically withstanding tensile forces up to 35,000 psi with a ¾ inch configuration. A forged, hardened clevis and locking pin would withstand tensile forces up to 70,000 psi with a ¾ inch configuration. Because of the strength of this material, the gate or gate post will usually fail before the latch breaks. The locking pin of the present invention allows the gate latch to be easily and quickly opened or closed. One convenience of the latch disclosed in this invention is that it can be used on any gate currently in use as an after market product. The gate does not need any special assembly as the latch can be attached to the gate with a few simple tools.

In the double gate latch embodiment, a U-shaped clevis is inserted through two hinges placed on the outside of two gate frames, or alternatively a gate frame and a gate post. As used herein the outside of the gate frame is defined as the side away from the gate opening. A locking pin is inserted through holes on the legs of the clevis. A locking sleeve slides along one leg of the clevis and over the locking pin. A lock is inserted through a hole in the locking pin. The clevis is now locked not only to the hinges, but around both gates. Thus, even if both hinges are removed from their mountings on the gates, the clevis remains around both gates preventing the gates from opening.

The single gate latch embodiment is similar to the double gate latch embodiment. This latch also uses a clevis, a locking pin and a locking sleeve. However, in this embodiment, there is only one hinge through which the clevis is placed. The clevis becomes secured to a gate post by looping through a hinge attached to that gate post, but instead of looping through a second hinge attached to the gate, the clevis is threaded through a portion of the gate itself, such as between the bars that make up the gate frame.

An alternative embodiment of the single hinge gate latch and the double hinge gate latch employs a clevis on which there is affixed a locking ring to one of the legs. The use of this locking ring eliminates the need for the locking sleeve. Once the locking pin is inserted through the openings of the clevis to secure the gate in the closed position, the handle end of the locking pin is rotated into contact with the locking ring affixed to the clevis. A lock may then be inserted through the opening in the end of the locking pin and the opening in the locking ring.

Finally, regarding both the single hinge and double hinge gate latch, a third embodiment of the devices employs a clevis having both a locking ring and a locking sleeve. In this fashion, the user may decide that the additional security provided by the locking sleeve is not required, thereby removing it and relying upon the security provided by the locking ring.

A fourth embodiment of the gate latch assembly, called the roller gate latch, is for use with gates that slidably open and close. In this embodiment, a gate slides toward the gate latch and is guided into the latch by a receiver. Once the gate moves into the latch, a locking pin is inserted through the gate structure. This locking pin prevents the gate from sliding open. A lock can be inserted through the locking pin and through the locking ring secured to the gate latch to secure the locking pin in place.

DETAILED DESCRIPTION

There are many different kinds of gates and fences used in a variety of settings. The double gate latch 36 and single gate 38 latch embodiments described below can be employed on many different kinds of gates by attaching the adjustable hinge 16 and the locking hinge 14 to the proper positions on the respective gates. For example, on most gates the adjustable hinge 16 will be attached to a secure terminal fence post, and the locking hinge 14 will be attached to the gate frame. However, if the gate is of the type where there are two gate doors that, when closed, meet in the middle of the opening, the adjustable hinge 16 and the locking hinge 14 will both be attached to a gate. Therefore, although a particular embodiment is only described in relation to one kind of gate, it is to be understood that the single and double gate latch embodiments can be employed on several kinds of gates, fences, and doors.

Figure 1:
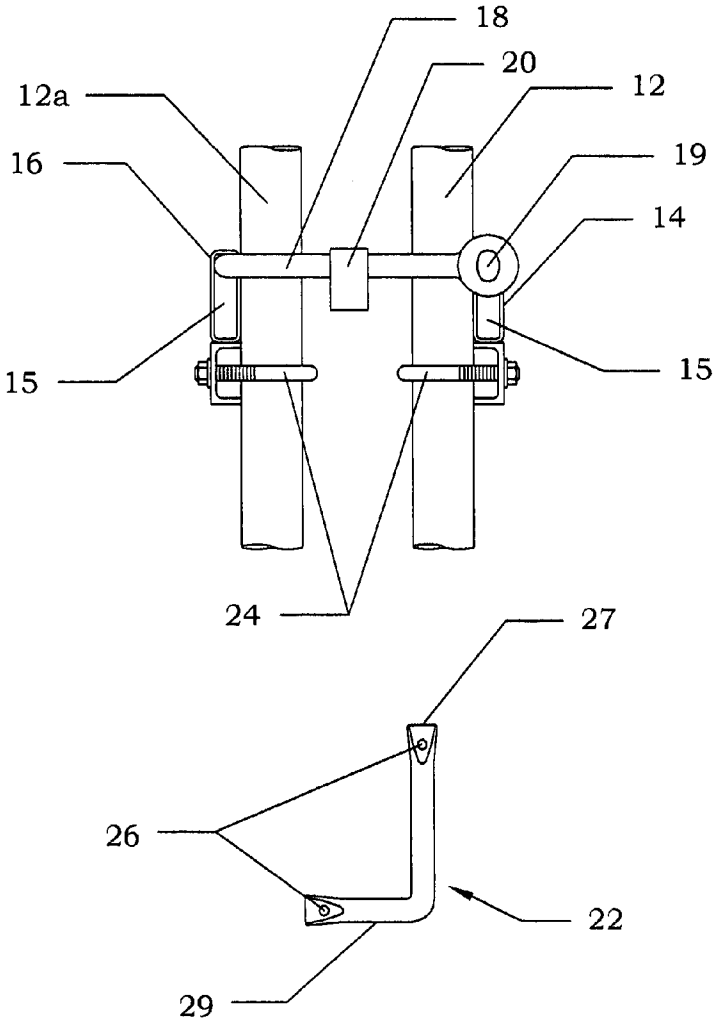
FIG. 1 is a perspective view of the double gate latch.
Figure 2:
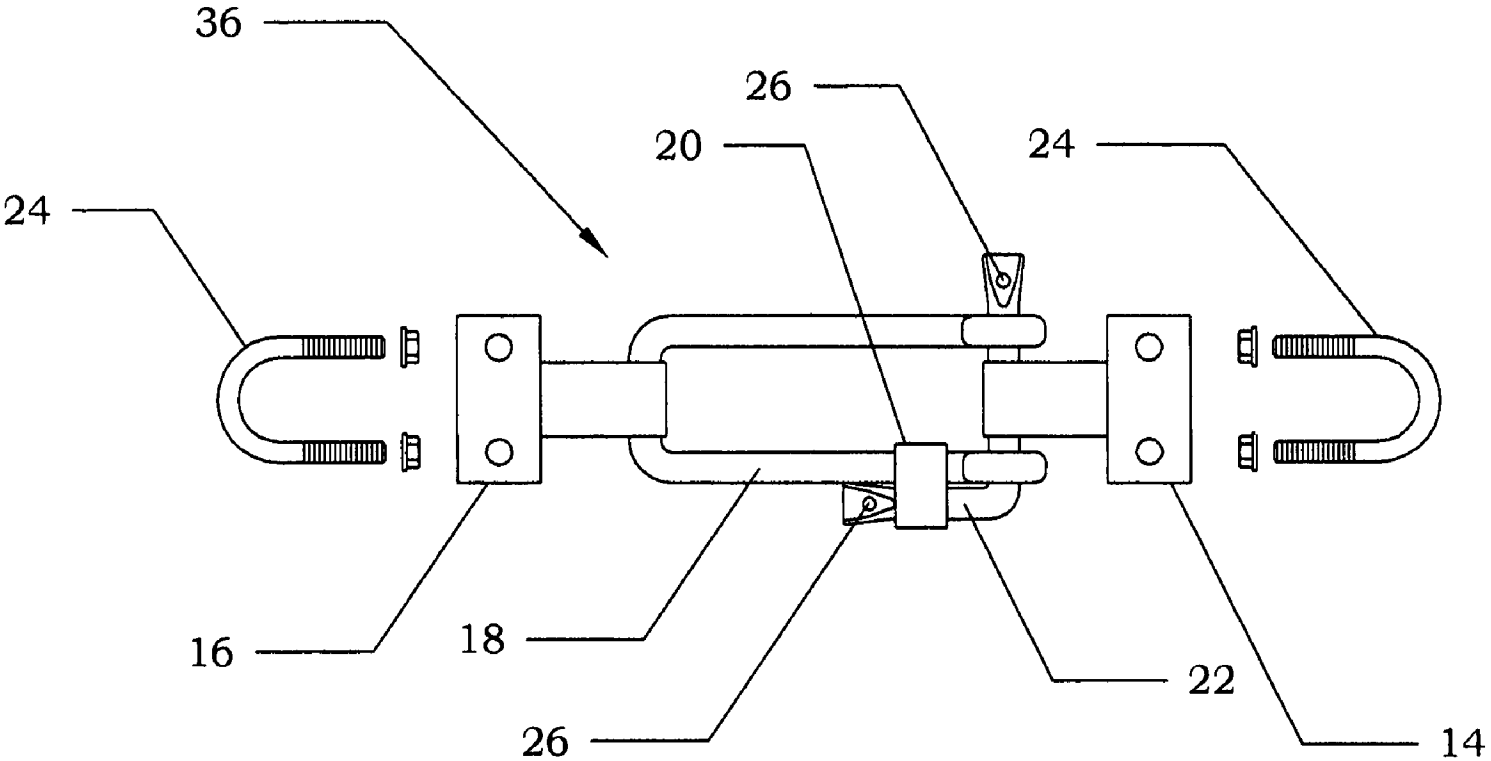
FIG. 2 is a top exploded view of the double gate latch.
Figure 7:
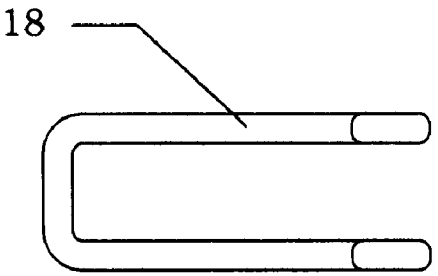
FIG. 7 is a top view of the clevis without a locking ring.

FIGS. 1 and 2 show the double gate latch embodiment 36. In this embodiment a locking hinge 14 is affixed to the outside of a gate frame 12, preferably with a U-bolt 24. An adjustable hinge 16 is affixed to the outside of a second gate frame 12*a*, preferably with a U-bolt 24. Both the locking hinge 14 and the adjustable hinge 16 contain openings 15 generally perpendicular to the plane of the gate. A U-shaped bar called a clevis 18 is inserted through the adjustable hinge 16. A top view of the clevis 18 is shown in FIG. 7. The clevis 18 can be made of any solid material, with the preferred material being stainless steel. The clevis 18 can be round or square in shape. In the preferred embodiment a square back clevis is used. The square back clevis 18 adds strength and durability to the invention for several reasons. Firstly, if force is applied to the clevis 18, the square back allows the force to be distributed along the entire width of the adjustable hinge 16, as opposed to only two points of contact in a round back clevis assembly. Secondly, the adjustable hinge 16 can be wider, which adds strength, since it does not have to accommodate for the arc shape of a round back. The ends of both of the legs of the clevis 18 are flared in a generally circular shape with openings contained therein creating holes 19 into which is received the locking pin 22. To lock the gate in a closed position, the clevis 18 is positioned so that the holes 19 are on either side of the opening in the locking hinge 14. An L-shaped locking pin 22 is then inserted through the hole 19 on one leg of the clevis 18, through the locking hinge opening 15, and then out the hole 19 on the other leg of the clevis 18. This locking pin 22 securely retains the gate in the closed position.

A locking sleeve 20 is positioned on one leg of the clevis 18. The locking sleeve 20 is large enough to fit over the clevis 18 and locking pin 22 at the same time. When the locking pin 22 is inserted through the opening 15 in the locking hinge 14, one arm of the locking pin 22 is positioned parallel to the clevis leg on which the locking sleeve 20 is positioned. The locking sleeve 20 is then slidably moved down the leg of the clevis 18 and over the locking pin 22. A lock is then inserted through the lock hole 26 in the locking pin 22. In the preferred embodiment, the lock hole 26 in the locking pin 22 is located in the handle portion of the locking pin 22, however the lock hole 26 can also be located in the inserting end of the locking pin 22 if that configuration is desired. The locking sleeve 20 is sufficiently large enough in diameter so that it fits over the clevis 18 and the locking pin 22, but is not so large as to slide over the lock locked to the locking pin 22. The lock thus prevents the locking pin 22 from being removed from the locking hinge 14.

The clevis 18 is a separate piece that can be removed from the hinges 14, 16 to position the locking sleeve 20 on either the inside or the outside of the gate. This allows the user to position the locking sleeve 20 and lock on the inside or outside of the gate, as preferred. The removability of the clevis 18 also allows the user to employ a clevis 18 of different length depending on the separation distance between the gates, thereby selecting the length of clevis 18 that will firmly retain the gate in juxtaposition to the fence.

In the double gate latch embodiment 36, the clevis 18 is run through the locking hinge 14 and the adjustable hinge 16. The adjustable 16 and locking hinges 14 are positioned on the outside of each respective gate frame so that the clevis 18 is also around both gate frames. As used herein the outside of the gate frame is defined as the side away from the gate opening. Thus, with the clevis 18, locking pin 22, and lock in place, the double gate latch 36 will keep the gate locked even if the adjustable 16 and locking hinges 14 are removed. It is the clevis 18 that keeps the gate locked, not the adjustable 16 and locking 14 hinges. However, the adjustable hinge 16 and locking 14 hinge do provide several functions, such as keeping the entire double gate latch assembly from sliding up and down on the gate. By adjusting the U-bolts 24, the adjustable 16 and locking 14 hinges can be placed at any height on the gate, depending on preference. Furthermore, the heights of each hinge can be adjusted to allow the clevis 18 to reach different lengths depending on the distance between the first and second gate frames. The adjustable 16 and locking hinges 14 can be offset to give the clevis 18 less reaching distance and allow the gate to close tightly and not blow in the wind.

Furthermore, the gate latch assembly keeps the gate from moving towards or away from the gate frame. Therefore, if there is weight on the gate (for example if people often climb over the gate), the gate latch assembly will allow the weight to be shared between the gate and the fence, thus reducing the stress on the gate's movable hinges and prolonging the life of the gate.

An alternative design of the double hinge gate latch 36 eliminates the locking sleeve 20 and employs a locking ring 30 affixed to one of the legs of the clevis 18. This embodiment is demonstrated in FIGS. 9 and 10. The locking ring 30 is affixed to the clevis 18 by welding or other secure means. For reasons of strength and security, however, it is preferred that the locking ring 30 is forged as an integral piece of the clevis 18. With this design, the locking pin 22 is inserted through the openings formed in the end of the clevis 18 to secure the double hinge gate latch 36 and gate in the closed position, then is rotated into a position nearly parallel with the leg of the clevis 18 with the end of the locking pin 22 coming to rest on the locking ring 30. The locking hole 26 located in the end of the locking pin 22 thus comes into alignment with the locking hole located in the locking ring 30, and a padlock or other locking mechanism is then inserted therein to securely retain the locking pin 22 in the closed position. Since the midline of the legs of the clevis and the midline of the locking pin when fully rotated to the closed position would reside within the same plane in the absence of the locking ring, it is preferred that the locking ring be beveled as depicted on FIG. 9. This beveling will allow the end of the locking pin to rest against the face of the locking ring with the holes aligned to receive a lock.

Finally, a third alternative design of the double hinge gate latch 36 utilized the clevis having the locking ring 30, but also employs the locking sleeve 20 made with a sufficiently large inner circumference so as to fit over the section of the clevis 18 forming the holes 19 that receive the locking pin 22. This embodiment of the double hinge gate latch 36 provides the user with the maximum options for security when using the locking sleeve 20, but may be easily manufactured as the clevis 18 having the locking ring 30 may be used. If the user desires to use the locking sleeve 20, it may be positioned on either side of the gate simply by turning the clevis 18 over while positioning the clevis 18 within the adjustable hinge 16. If the user does not require such a level of security, the locking sleeve 20 may simply be removed with the lock being placed through the locking pin 22 and the locking ring 30.

Figure 3:
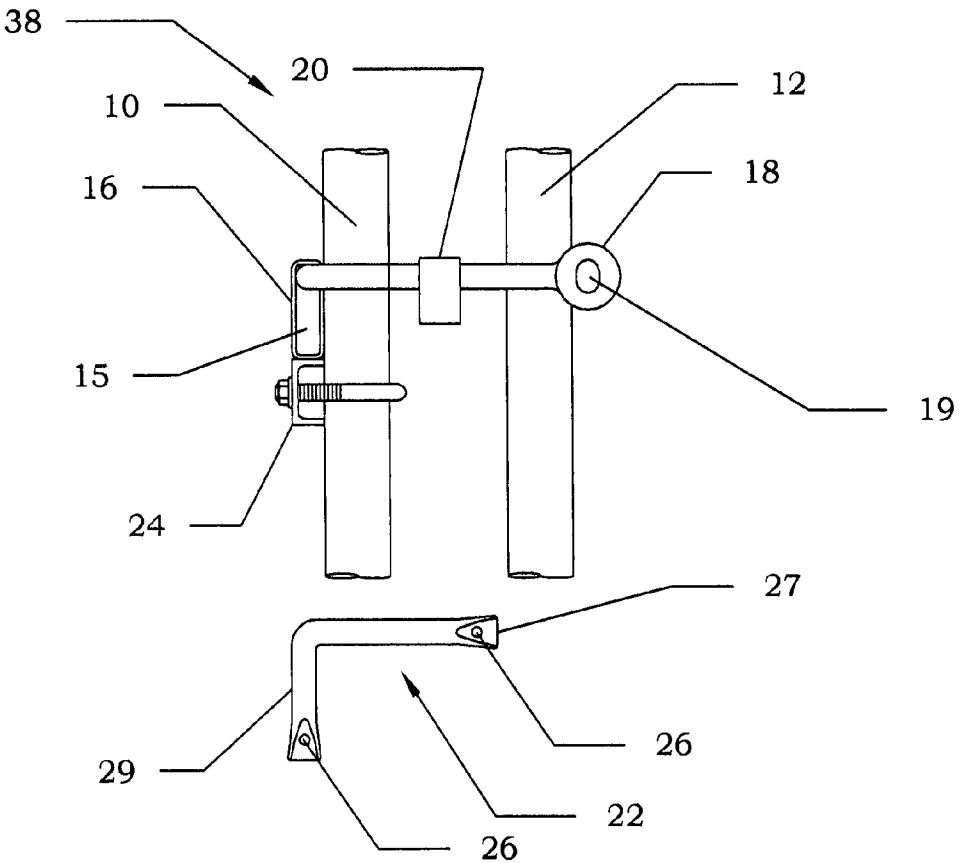
FIG. 3 is a perspective view of the single gate latch.
Figure 4:
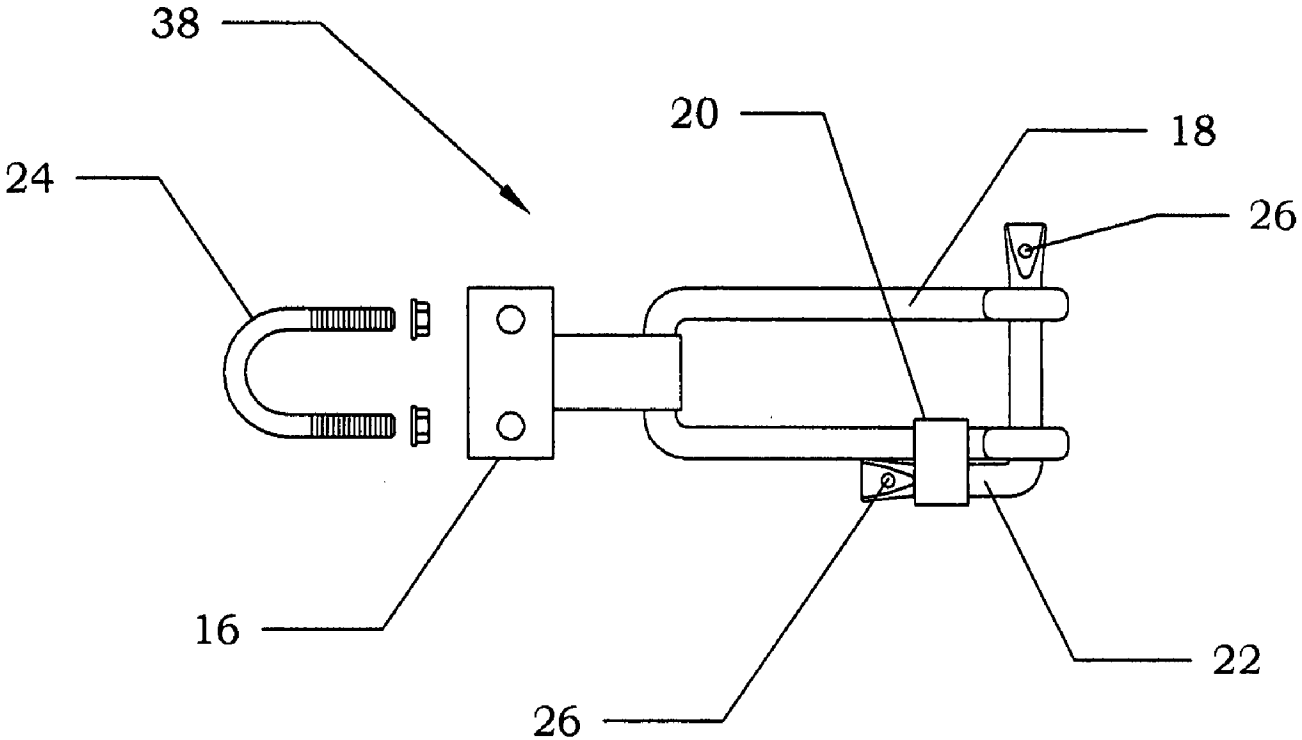
FIG. 4 is a top view of the single gate latch.

FIGS. 3 and 4 show a second embodiment of the invention called the single gate latch. In this embodiment the adjustable hinge 16 is placed on a terminal post 10. The clevis 18, locking pin 22, and locking sleeve 20 are identical to those described in the first embodiment, however, in this second embodiment there is no locking hinge for the locking pin 22 to slide through. The locking pin 22 is positioned through the holes in the clevis 18 and through a secure portion of the gate, such as between the frame, if used with a chain link fence, or bars, if used with a tubular steel gate. The entire single gate latch 38 of the second embodiment can be made out of any rigid material, however stainless steel is preferred. Because of the strength of the adjustable hinge 16 and the gate latch assembly, the entire gate latch apparatus is extremely strong. In most instances the gate or terminal post 10 will break before the gate latch would give way.

This second embodiment can be used with many different kinds of fences. Two examples include a chain link fence or a tubular steel gate. Different kinds of materials are used to construct different kinds of fences. Therefore, the mounting mechanism of the adjustable hinge 16 may change depending on what kind of material is used to construct the terminal post 10. For example, if the adjustable hinge 16 is attached to a wooden post, it may be attached with a nail or a bolt. However, if the adjustable hinge 16 is attaching to a steel post, it may be welded or secured with U-bolts.

The second embodiment does not have a locking hinge for the locking pin 22 to slide through; therefore, the locking pin 22 can be positioned through the gate frame 12 and under a sturdy structural member of the gate frame 12, such as a tubular bar. This takes weight off of the movable hinges of the gate by allowing the weight of the gate to be supported by the sturdy latch assembly. This may lengthen the life of the gate, especially if people often climb over the gate.

Figure 9:
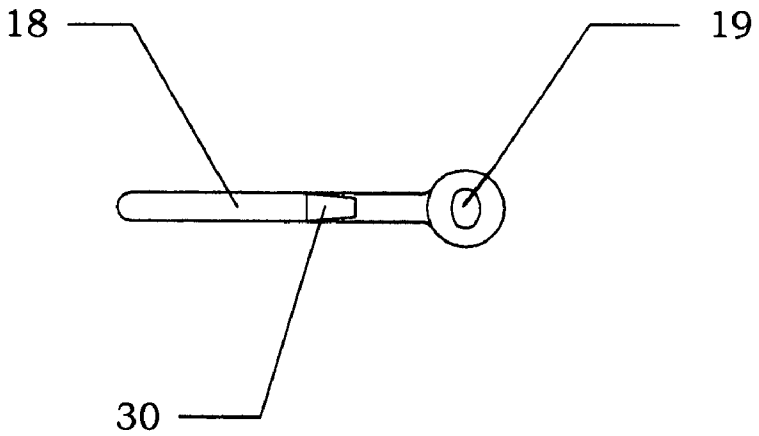
FIG. 9 is a side view of the clevis having a locking ring affixed thereto.
Figure 10:
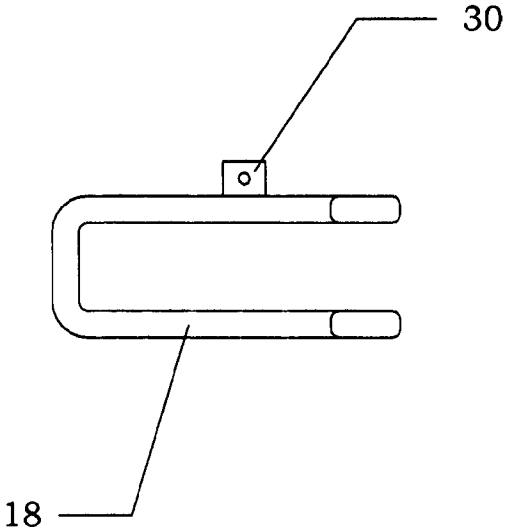
FIG. 10 is a top view of a clevis having a locking ring affixed thereto.

As with the double gate latch 36, the single gate latch 38 may employ an alternative embodiment using the clevis 18 having the locking ring 30, thus eliminating the need for the locking sleeve 20. The same clevis 18 depicted in FIGS. 9 and 10 is used in and functions identically in either alternative embodiment. Further, the clevis 18 having the locking ring 30 may be employed in the single gate latch 38 along with the locking sleeve 20 in identical fashion as described above regarding the double hinge gate latch 36. Like the double gate latch 36, for reasons of safety and security of the property protected by the fencing which employs the gate latch, the embodiment utilizing the locking sleeve 20 provides the maximum protection. The primary motivation for the alternative embodiment employing the locking ring is ease of manufacture. Accordingly, the preferred embodiment of both the double hinge gate latch 38 and the single hinge gate latch 36 will offer the user the clevis 18 having a locking ring 30 and the locking sleeve 20.

Figure 5:
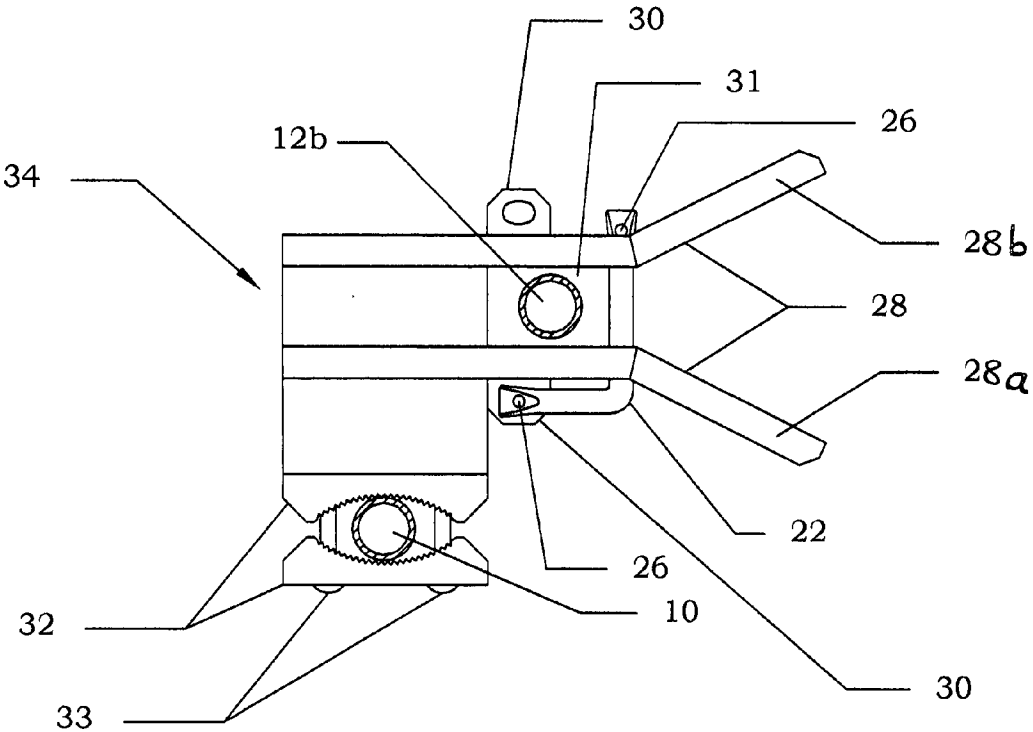
FIG. 5 is a top view of the roller gate latch.
Figure 6:
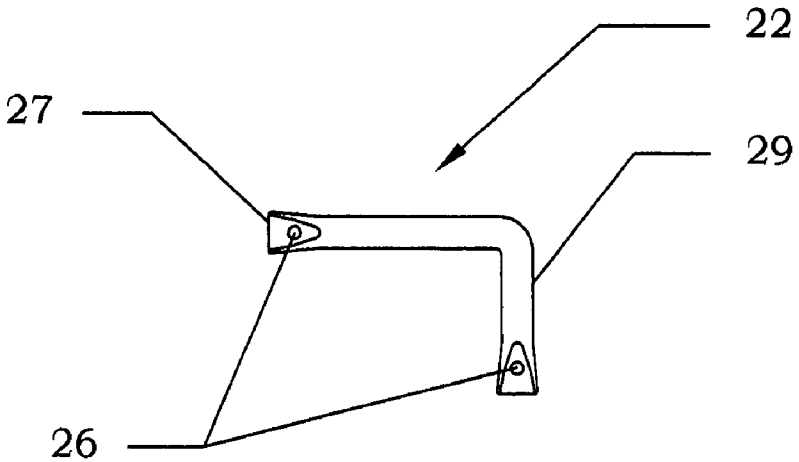
FIG. 6 is a top view of the locking pin.

FIG. 5 shows a fourth embodiment of the invention called the roller gate latch 34. This latch system is for use with gates that slide shut, usually on rollers or any comparable mechanism. These gates operate in the same plane as the rest of the fence rather than having hinges that allow the gate to open at an angle to the fence line. The roller gate latch 34 comprises a gate receiver 28 that catches and guides the gate 12*b* into a latch gate cavity 31 as the gate 12*b* slides shut. The receiver 28 is comprised of an inside guide 28*a* with a flat end and a flared end, and an outside guide 28*b* with a flat end and a flared end. Each guide is positioned opposite from each other to define the latch cavity 31. Once in the latch cavity 31, a locking pin 22 is inserted through the gate receiver 28 to keep the gate closed. A lock is then inserted through the locking pin 22 and through a locking ring 30 attached to the gate receiver 28. The roller gate latch assembly body can be attached to any secure object through any means. It can be welded or built into the terminal post 10. In the preferred embodiment the entire roller gate latch assembly 34 body is attached to a terminal post 10 with a retaining clamp 32 and carriage bolts 33. The roller gate latch 34 can made out of any sturdy material, however stainless steel is used in the preferred embodiment.

The roller gate latch embodiment is like the above single and double gate latch embodiments in that it can be mounted either on the inside or outside of the gate, allowing the owner to be able to lock the gate from either the inside or outside, as preferred.

Figure 8:
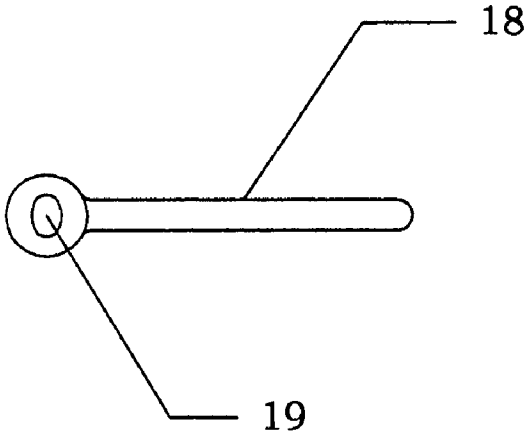
FIG. 8 is a side view of the clevis without a locking ring.

In all the first two embodiments of the gate latch apparatus, the preferred embodiment of each would employ a clevis 18 with openings that are not concentric, but are configured to create an elongated, off center opening, generally oval in shape, as shown in FIG. 8. The fourth embodiment would also employ oval openings, however, instead of being in the clevis 18, the oval openings would be in the inside guide 28*a* and the outside guide 28*b* of the receiver 28. Further, as shown in FIG. 1, the inserting tip 27 of the locking pin 22 is flattened which extends the outer edges of the inserting tip 27 beyond the outer diameter of the locking pin 22. In configuring the clevis holes 19 and locking pin inserting tip 27 in this fashion, the locking pin 22 cannot be inserted through the clevis holes 19 unless the locking pin 22 is positioned at about a 90° angle from the clevis 18. Such configuration prevents a would-be intruder from applying a point load to the inserting tip 27, thereby possibly driving the locking pin 22 out of the clevis 18. The only way that the gate latch could be opened is to unlock the pad lock retaining the locking sleeve 20 over the handle 29 of the locking pin 22, which positioning retains the handle 29 of the locking pin 22 parallel to the elongated arms of the clevis 18. Once the pad lock is removed, the locking sleeve 20 may be slidably removed from over the handle 29 of the locking pin 22, with the handle 29 thereafter rotated about 90° and slidably removed from its retained position within the locking hinge 14 and the clevis holes 19.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A latch assembly used for securing in the closed position a double swinging gate, said gate having a first pivoting gate section and a second pivoting gate section each having an inside edge and an outside edge, said latch assembly comprising:

a first hinge having a first opening, said first hinge adapted to be attached to the first pivoting gate section;

a second hinge having a second opening, said second hinge adapted to be attached to the second pivoting gate section;

a detachable clevis having two legs with an opening formed in each leg, said clevis being received in the first opening in the first hinge;

a locking pin having a first end and a second end, said second end being received in the openings formed in the legs of the clevis and adapted to be received in the second opening in the second hinge; and a locking sleeve having an interior opening to receive the locking pin and one leg of the clevis, the locking sleeve thereby securing the clevis to the locking pin.

2. The apparatus of claim 1 wherein the first and second end of the locking pin have an opening for receiving a lock.

3. The latch assembly of claim 1 wherein the first end of the locking pin extends through the interior opening of the locking sleeve.

4. The latch assembly of claim 1 wherein the openings in the clevis legs are oval.

5. The latch assembly of claim 1 wherein the angles forming the clevis legs are about 90 degrees to create a square back.

6. The latch assembly of claim 1 wherein said first and second ends are flattened and flared.

7. The latch assembly of claim 1 wherein the first hinge is connected to a secure object with a U-bolt.

8. The latch assembly of claim 1 wherein the second hinge is connected to a secure object with a U-bolt.

9. The latch assembly of claim 1 wherein the first hinge is connected to a secure object with bolts, screws or nails.

10. The latch assembly of claim 1 wherein the second hinge is connected to a secure object with bolts, screws or nails.

11. The latch assembly of claim 1 wherein the latch assembly is made of stainless steel.

12. A latch assembly used for securing in the closed position a double swinging gate, said gate having a first pivoting gate section and a second pivoting gate section each having an inside edge and an outside edge, said latch assembly comprising:

a first hinge having a first opening, wherein said first hinge is adapted to be attached to the first pivoting gate section so that the first opening in the first hinge is positioned on the outside edge of the first pivoting gate section;

a second hinge having a second opening, wherein said second hinge is adapted to be attached to the second pivoting gate section so that the second opening in the second hinge is positioned on the outside edge of the second pivoting gate section;

a detachable clevis having two legs with an opening formed in each leg, said clevis being received in the first opening in the first hinge;

a locking pin having a first end and a second end, said second end being received in the openings formed in the legs of the clevis and adapted to be received in the second opening in the second hinge; and a locking sleeve having an interior opening to receive the locking pin, the locking sleeve thereby securing the clevis to the locking pin.

* * * * *